US007328538B2

(12) United States Patent
Trangsrud

(10) Patent No.: US 7,328,538 B2
(45) Date of Patent: Feb. 12, 2008

(54) REBAR SPACER

(76) Inventor: Julian P. Trangsrud, 300 Cherry St., Northfield, MN (US) 55057

( * ) Notice: Subject to any disclaimer, the term of this patent is extended or adjusted under 35 U.S.C. 154(b) by 427 days.

(21) Appl. No.: 10/722,890

(22) Filed: Nov. 26, 2003

(65) Prior Publication Data

US 2005/0108976 A1 May 26, 2005

(51) Int. Cl.
*E04C 5/16* (2006.01)

(52) U.S. Cl. ..... 52/682; 52/689

(58) Field of Classification Search ..... 52/677, 52/682, 689

See application file for complete search history.

(56) References Cited

U.S. PATENT DOCUMENTS

| | | | | |
|---|---|---|---|---|
| 3,449,882 | A * | 6/1969 | Bigglestone et al. | 52/689 |
| 3,673,753 | A | 7/1972 | Anderson | 52/685 |
| 3,788,025 | A | 1/1974 | Holmes | 52/685 |
| 4,598,523 | A | 7/1986 | Tolliver | 52/685 |
| 4,840,334 | A * | 6/1989 | Kikuchi | 248/73 |
| 5,107,654 | A | 4/1992 | Leonardis | 52/685 |
| 5,216,866 | A | 6/1993 | Ekedal | 52/677 |
| 5,791,816 | A * | 8/1998 | McCallion | 404/136 |
| 6,276,108 | B1 | 8/2001 | Padrun | 52/684 |
| 6,557,317 | B2 | 5/2003 | Sorkin | 52/684 |
| 6,837,017 | B2 * | 1/2005 | Hardy et al. | 52/685 |
| 6,910,309 | B2 * | 6/2005 | Trangsrud | 52/685 |
| 2004/0031228 | A1 * | 2/2004 | Hardy et al. | 52/687 |

* cited by examiner

*Primary Examiner*—Robert Canfield
*Assistant Examiner*—Jessica Laux
(74) *Attorney, Agent, or Firm*—Steven E. Kahm; Nikolai & Mersereau, P.A.

(57) ABSTRACT

A rebar spacer having a clip for securely holding a rebar centered in the clip such that the rebar cannot be dislodged from the clip once the clip engages the rebar. The clip is held at a desired height by a base, which will not easily tip over do to a wide stance of the base of the rebar spacer. The rebar spacer will quickly and easily accept the rebar in the clip. The rebar spacers can have a large or small footprint at the surface of the concrete. The rebar spacer can be made of lightweight, durable plastic. The rebar spacer can be molded as one inexpensive piece. The rebar spacer can have a variety of heights and accept a variety of rebar sizes.

11 Claims, 3 Drawing Sheets

REBAR SPACER

BACKGROUND OF THE INVENTION

1. Field of the Invention

This invention relates to support devices for securely holding concrete reinforcing rods and wire in a fixed position.

2. Description of the Related Art

In the past support devices for holding reinforcing rods at a particular height in concrete have had several drawbacks. One of the drawbacks has been the inability of the support devices to hold the reinforcing bar at a precise position without it coming out of the support device as forces are placed on the reinforcing bar. It is desired to have a reinforcing bar support device, which can securely hold the reinforcing bar in the support device without it coming out or wiggling around in the support device. The support device should also be stable such that it will not tip over and should have a small footprint at the base.

SUMMARY OF THE INVENTION

The rebar spacer has a rebar holding clip for securely engaging and supporting a rebar and a base portion for supporting the rebar holding clip at a desired height in the concrete form.

The rebar holding clip has a "U" shaped rebar holding portion where the base of the rebar holding portion fits the size and shape of the rebar to securely hold it in place. The clip has arms which will admit the rebar to the clip by bending back out of the way as the rebar is forced downward into the base portion. The arms will then snap back into their normal position to hold the rebar securely in place then the rebar is nested in the "U" shaped base portion of the clip. In this manner the rebar is secured in the clip and cannot be removed by forces placed on the rebar.

The base portion holds the clip at a desired height such that the rebar is placed in the concrete at a known fixed position to maximize its effectiveness in reinforcing the concrete. The base portion may have many different configurations including having a flat base with a large surface area to support the rebar spacer or legs with feet for contacting the ground or walls in which the rebar supports rest. The legs offer a lower footprint at the surface of the concrete for a stronger concrete wall at the surface.

The base portion may have a flat base or legs which should be spread over a large enough area to prevent the rebar spacer from tipping over when holding the rebar, thereby providing a reliable positioning of the rebars.

The height of the base will vary depending on the desired placement of the rebar in the concrete. The higher the base portion the more material and supporting structure there will be and the larger the base will have to be.

The clips may be made for different size rebars and the supporting structure of the base will also be different for the different size loads it is expected to support.

OBJECTS OF THE INVENTION

It is an object of the invention to provide a rebar spacer for holding rebars and wire securely so that they will not come out of the rebar spacer.

It is an object of the invention to provide a rebar spacer for holding rebars and wire at a fixed distance from the base of a concrete form.

It is an object of the invention to provide a rebar spacer with a wide stance so that it will not tip over when holding the rebar.

It is an object of the invention to provide a rebar spacer for quickly and easily securing rebars and wire in the rebar spacer.

It is an object of the invention to provide a rebar spacer with a small footprint.

It is an object of the invention to vary the size of the clips for different size rebars.

It is an object of the invention to vary the height of the clips for different heights of the rebars in a concrete mold.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
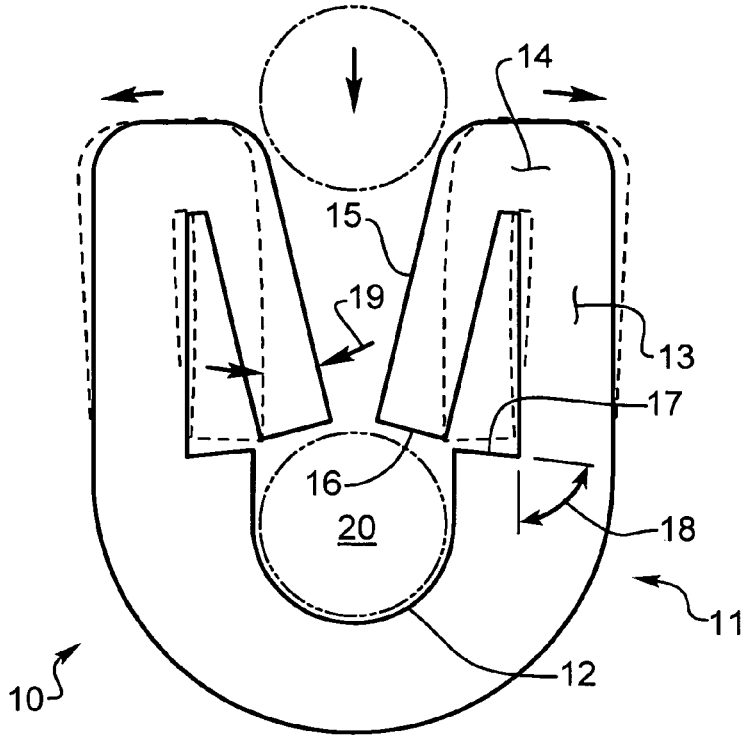
FIG. 1 is a front view of the rebar holding clip portion of the rebar spacer.

The rebar holding clip 10 is shown in detail in FIG. 1. It has a rebar engaging portion 11 which is "U" shaped and has a "U" shaped clip base portion 12. The rebar holding clip 10 also has two arm supporting columns 13 one on either side of the "U" shaped clip base portion 12. Each arm supporting columns 13 has a cross member portion 14 for connecting the arm supporting columns 13 to an arm portion 15 angling inward from the arm supporting columns 13 toward the open end of the "U" shaped clip base portion 12 near the center of rebar holding clip 10.

The arm end 16 of arm portion 15 can traverse angle 19 such that the arm end 16 is opposite plane 17 on the rebar engaging portion 11. As can be understood from FIG. 1 when rebar 20 is pushed downward between the arm portions 15, the arm portions 15 are spread apart over angle 19, allowing the arm to be substantially recessed over the plane 17, until rebar 20 is admitted into "U" shaped clip base portion 12. Then arms 15 rebound such that arm ends 16 oppose the top of the rebar 20 locking it inside of the rebar engaging portion 11 of the rebar holding clip 10.

The arms 15 are designed to have their ends 16 engage the rebar 20 at angles such that the rebar 20 is held snugly in the recess of the clip base portion 12 with the ends of the arms 16 blocking the escape of the rebars 20 by engaging the rebar's circumference.

The plane 17 is angled as shown by angle 18 such that the arm end 16 of arm portions 15 is parallel to the plane 17 when the arm end is opposite the plane 17.

Figure 2:
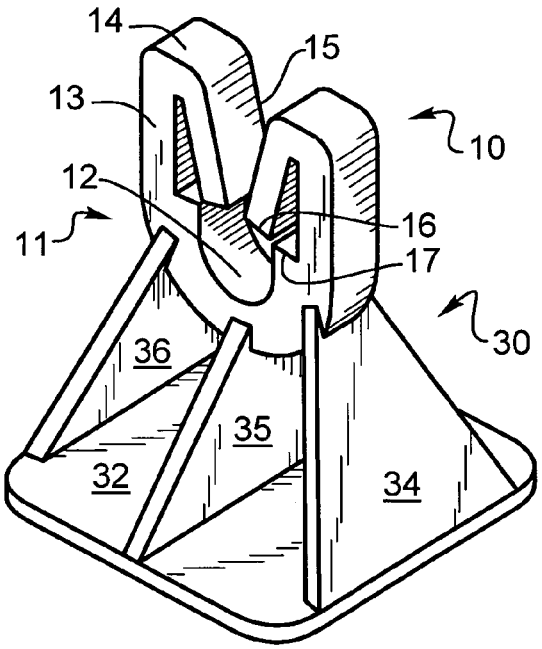
FIG. 2 is a perspective view of the rebar holding clip portion mounted on a first style base portion of a first height.
Figure 3:
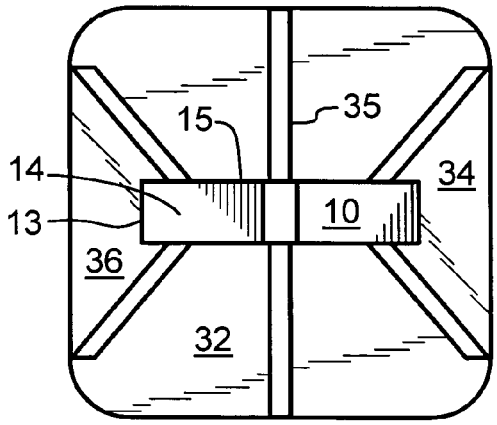
FIG. 3 is a top view of the rebar holding clip portion mounted on a first style base portion of a first height.

The rebar holding clip 10 is supported at a fixed height within a concrete form by resting on a base portion. The base portions may be of different styles. In a first embodiment the rebar holding clip 10 is attached to a base portion 30 as shown in FIG. 2. The base portion 30 has a base 32, right support wall 34, a left support wall 36, and a central support wall 35 for supporting the rebar holding clip 10 a fixed distance above the base 32. As shown in FIGS. 2 and 3 the right support wall 34 and left support wall 36 and angled inward from the edge of the base 32 to the ends of the rebar holding clip 10. The central support wall 35 extends vertically from the base 32 to the bottom of the center part of the rebar holding clip 10.

Figure 4:
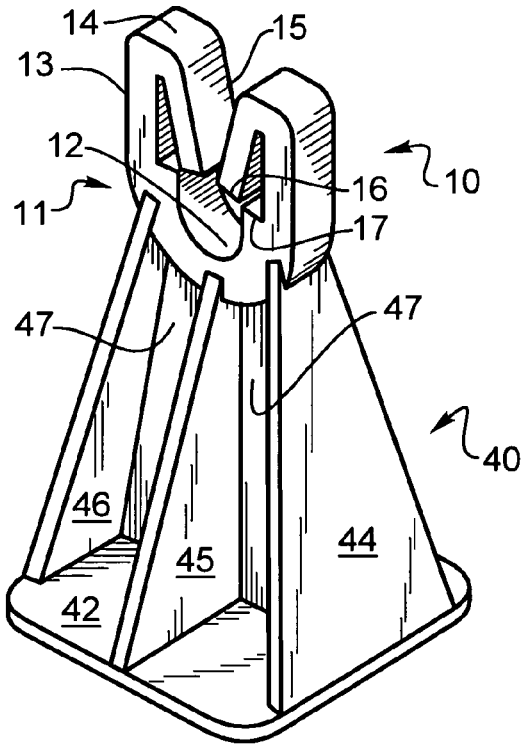
FIG. 4 is a perspective view of the rebar holding clip portion mounted on a first style base portion of a second height.
Figure 5:
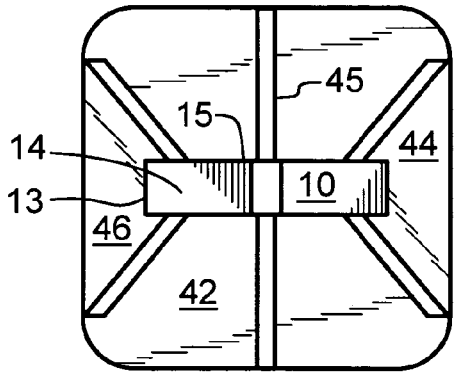
FIG. 5 is a top view of the rebar holding clip portion mounted on a first style base portion of a second height.

In a second embodiment as shown in FIG. 4 the rebar holding clip 10 is attached to a base portion 40 as shown in FIG. 4. The base portion 40 has a base 42, right support wall 44, a left support wall 46, a central support wall 45 and a cross support wall 47 extending between the left wall 46 and the central wall 45 and between the central wall 45 and the right wall 44, for supporting the rebar holding clip 10 a fixed distance above the base 42. As shown in FIGS. 4 and 5 the right support wall 44 and left support wall 46 and angled inward from the edge of the base 42 to the ends of the rebar holding clip 10. The central support wall 45 and the cross support wall 47 extend vertically from the base 42 to the bottom of the center part of the rebar holding clip 10.

In the second embodiment as shown in FIG. 4 the rebar holding clip 10 is held at a higher position than in the first embodiment as shown in FIG. 2. The second embodiment therefore may have the cross support wall 47 to hold the rebar 20 without the rebar holding clip 10 bending or twisting on the base portion 40.

Figure 6:
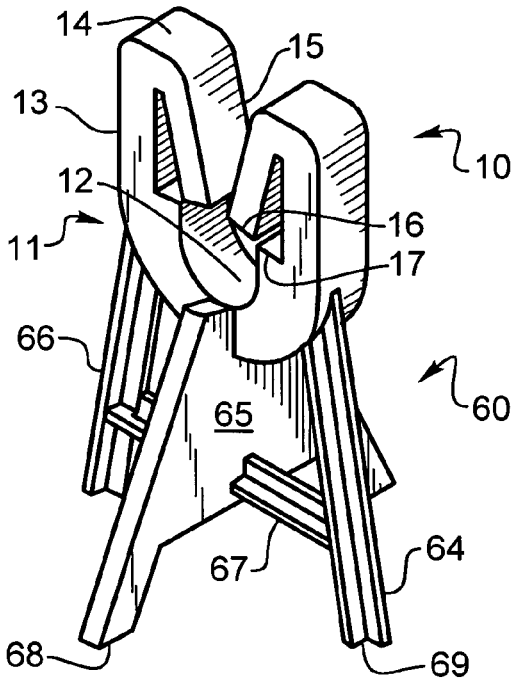
FIG. 6 is a perspective view of the rebar holding clip portion mounted on a second style base portion.

In a third embodiment as shown in FIG. 6 the rebar holding clip 10 is held in place by base portion 60. Base portion 60 has right angled leg 64, left angled leg 66 and a vertical central wall 65. A support beam 67 runs from the left angled leg 66 to the vertical central wall 65 and from the vertical central wall 65 to the right angled leg 64. The feet 68 on the vertical central wall 65, the feet 69 on the right and left angled legs 64, 66 determine the bottom of the base portion 60 without having the large footprint such as the bases 32 and 42 of the embodiments as shown in FIGS. 2, 3, 4 and 5. Having a smaller footprint is advantages for lessening the amount of surface area of the concrete with the base extending therefrom. In some applications the base of the base portion will weaken the surface of the concrete.

Figure 7:
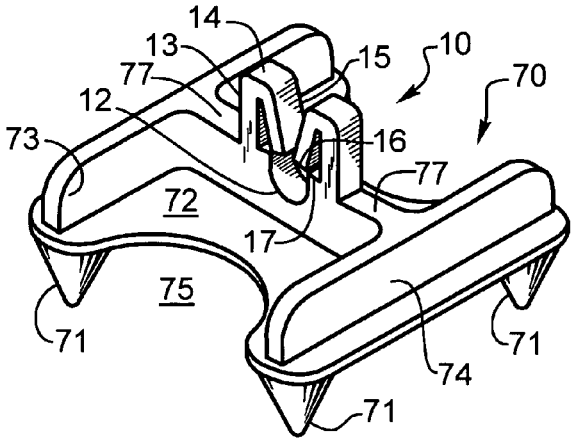
FIG. 7 is a perspective view of the rebar holding clip portion mounted on a third style base portion of a first height.
Figure 8:
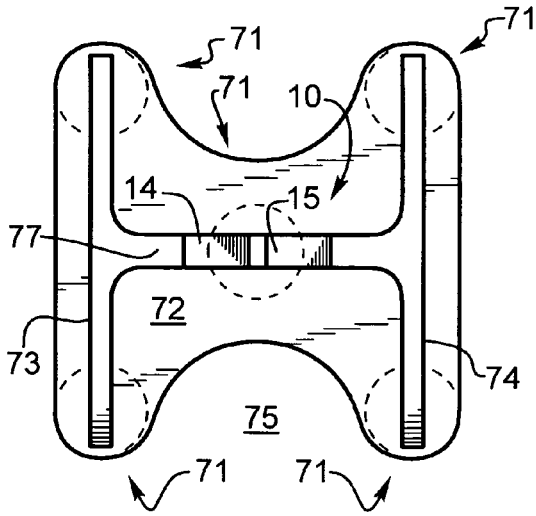
FIG. 8 is a top view of the rebar holding clip portion mounted on a third style base portion of a first height.

In a fourth embodiment as shown in FIGS. 7 and 8 the rebar holding clip 10 is supported by a base portion 70 having feet 71 which may be cone shaped to limit the footprint at the bottom of the base portion 70. The feet 71 support a base 72 having a left wall 73 and a right wall 74 with a cross wall 77 therebetween resting on the base 72 and connecting the left wall 73 and a right wall 74 to the rebar holding clip 10 which is also resting on the base 72. The base 72 may have a cut out section 75 to reduce the amount of material used in the base portion 70 and to increase the amount of contiguous concrete for greater strength of the concrete.

The base portion 70 may have four feet 71 one in each corner, or five feet with a central foot 71 directly beneath the center of the base portion under the rebar holding clip 10 to prevent it from sagging in the middle and therefore not supporting the rebar 20 at the proper position.

Figure 9:
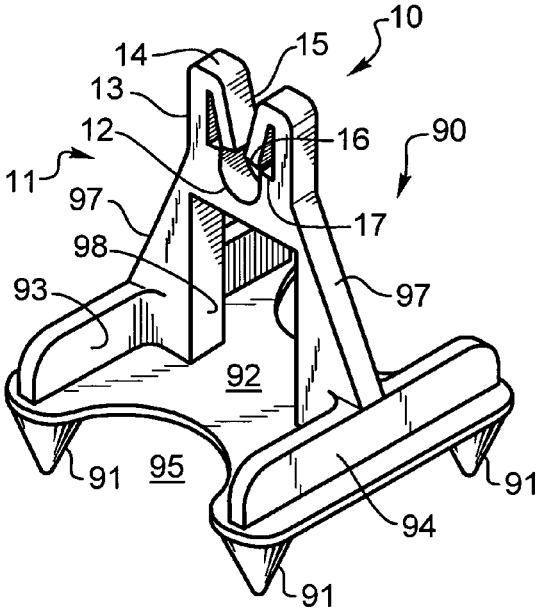
FIG. 9 is a perspective view of the rebar holding clip portion mounted on a third style base portion of a second height.
Figure 10:
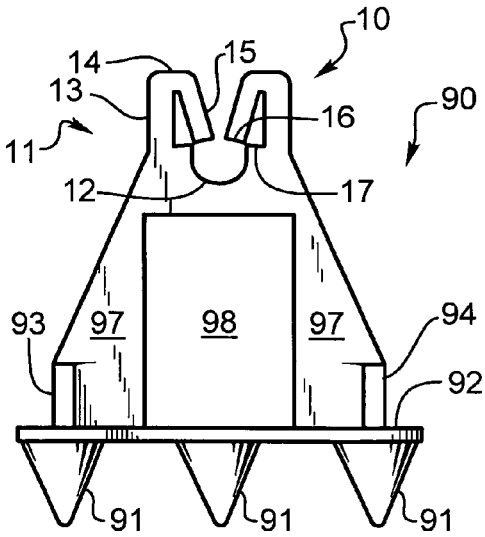
FIG. 10 is a front view of the rebar holding clip portion mounted on a third style base portion of a second height.

In a fifth embodiment as shown in FIGS. 9 and 10 the rebar holding clip 10 is supported by the base as shown in FIGS. 7 and 8 but at a higher position. Here the base portion 90 has feet 91, which may be cone shaped to limit the footprint at the bottom of the base portion 90. The feet 91 support a base 92 having a left wall 93 and a right wall 94. The cross wall 97 rests on the base 92 and connects to the rebar holding clip 10 which is supported some distance above base 92. There may be an opening 98 between the walls 97 and the between the base 92 and the rebar holding clip 10 to reduce the amount of material used in the base portion 90 and to increase the amount of contiguous concrete for greater strength of the concrete. Alternatively the volume shown by opening 98 may be filled by the extension of walls 97 beneath the holding clip portion 10. The base 92 may have a cut out section 95 to reduce the amount of material used in the base portion 90 and to increase the amount of contiguous concrete for greater strength of the concrete.

In general the rebar holding clip 10 is supported stably at a fixed distance above the base of a concrete form for holding the rebar at a know position such that when the concrete is pored into the mold the rebar will be fixed in place and will not be dislodged from the rebar holding clip. The base portions can be any of a variety of styles of which the above embodiments are a sample.

The rebar spacers may be made from plastics such as polyvinyl chlorides which can be molded in one piece, are strong, light weigh, resilient and low cost.

The bases 32 and 42 in FIGS. 2 and 4 may have legs such as 71 and 91 shown in FIGS. 7 and 9 or other style legs to provide a smaller footprint of the base at the surface of the concrete.

The bases 32, 42, 72, 92 and the feet 71, 91 or the legs 64 and feet 68 of the rebar spacer should be placed wide enough apart to provide stability such that the rebar spacer will not tip over when a rebar is installed therein.

Obviously, many modifications and variations of the present invention are possible in light of the above teachings. It is therefore to be understood that, within the scope of the appended claims, the invention may be practiced otherwise than as specifically described.

What is claimed is:

1. A rebar spacer comprising, one clip having a bottom portion with a semicircular rebar cradling portion, a pair of columns one on either side of the semicircular rebar cradling portion and extending upward therefrom, a cross portion on each column extending toward the opposing column, a straight arm extending angularly downward from each cross portion toward the axis of the radius of the semicircular rebar cradling portion and having an end proximate a rebar placed in the cradling portion, a shoulder portion on each side of the semicircular rebar cradling portion, between the semicircular rebar cradling portion and the columns, each shoulder portion having a width to allow the arm to be substantially recessed over the shoulder, a base portion attached to the base of the clip for supporting the clip at a desired height, the clip being centered over the middle of the length and width of the base portion.

2. A rebar spacer as in claim 1 wherein, the base portion has a flat base, a left wall extending from the flat base to the bottom of the clip and center wall extending from the base to the bottom of the clip and a right wall extending from the flat base to the bottom of the clip.

3. A rebar spacer as in claim 2 wherein,

The left and right walls are slanted inward from the edge of the flat base to the sides of the clip, and the center wall is perpendicular to the flat base and the base of the clip.

4. A rebar spacer as in claim 2 wherein, a cross wall extends between the flat base and the bottom of the clip, between the right wall and the center wall and between the left wall and the center wall.

5. A rebar spacer as in claim 1 including, a left leg extending from the bottom of the clip, a center wall extending from the bottom of the clip and a right leg extending from the bottom of the clip, a cross brace from the center wall to the left leg and a cross brace from the center wall to the right leg.

6. A rebar spacer as in claim 5 wherein, the center wall has feet extending below the wall.

7. A rebar spacer as in claim 2 wherein, the flat base has feet thereunder.

8. A rebar spacer as in claim 1 wherein, the base portion has a flat base thereunder, the flat base has a left wall, a right wall and a cross wall extending between the left and right walls with the clip integral with the cross wall such that the "U" shaped rebar receiving portion receives the rebar between the left and right walls.

9. A rebar spacer as in claim 8 wherein, the base has feet thereunder.

10. A rebar spacer as in claim 8 wherein, the flat base has a portion of the base between the left and right walls removed.

11. A rebar spacer as in claim 10 wherein, the base has feet thereunder.

* * * * *